US007913611B2

(12) United States Patent
Terry et al.

(10) Patent No.: US 7,913,611 B2
(45) Date of Patent: Mar. 29, 2011

(54) BLAST AND BALLISTIC PROTECTION SYSTEMS AND METHOD OF MAKING THE SAME

(75) Inventors: Matthew M. Terry, Charlottesville, VA (US); Haydn N. G. Wadley, Keswick, VA (US)

(73) Assignee: University of Virginia Patent Foundation, Charlottesville, VA (US)

( * ) Notice: Subject to any disclaimer, the term of this patent is extended or adjusted under 35 U.S.C. 154(b) by 984 days.

(21) Appl. No.: 10/526,416

(22) PCT Filed: Sep. 3, 2003

(86) PCT No.: PCT/US03/27605

§ 371 (c)(1),
(2), (4) Date: Mar. 2, 2005

(87) PCT Pub. No.: WO2004/022868

PCT Pub. Date: Mar. 18, 2004

(65) Prior Publication Data

US 2006/0048640 A1 Mar. 9, 2006

Related U.S. Application Data

(60) Provisional application No. 60/407,723, filed on Sep. 3, 2002.

(51) Int. Cl.
*F41H 5/04* (2006.01)

(52) U.S. Cl. ..... 89/36.02

(58) Field of Classification Search ..... 89/36.02; 114/241, 240 C, 240 E

See application file for complete search history.

(56) References Cited

U.S. PATENT DOCUMENTS

| | | | |
|---|---|---|---|
| 1,154,254 | A | 9/1915 | Lachman |
| 2,288,104 | A | 6/1942 | Pasquier |
| 2,481,046 | A | 9/1949 | Scurlock |
| 2,789,076 | A | 4/1957 | Frieder |
| 3,298,402 | A | 1/1967 | Hale |
| 3,783,969 | A | 1/1974 | Pall |
| 3,795,288 | A | 3/1974 | Pall |
| 3,857,217 | A | 12/1974 | Reps |
| 3,869,778 | A | 3/1975 | Yancey |
| 3,971,072 | A | 7/1976 | Armellino |
| 3,996,082 | A | 12/1976 | Leatherman |
| 4,001,478 | A | 1/1977 | King |
| 4,019,540 | A | 4/1977 | Holman |
| 4,027,476 | A | 6/1977 | Schmidt |
| 4,037,751 | A | 7/1977 | Miller |
| 4,038,440 | A | 7/1977 | King |

(Continued)

OTHER PUBLICATIONS

Wadley, "Electron Beam—Directed Vapor Deposition of Superthermal Conducting Structures" Jun. 13-15, 2001 (this reference was previously submitted Jun. 25, 2007, but with incorrect title).

(Continued)

*Primary Examiner* — Stephen M Johnson
(74) *Attorney, Agent, or Firm* — Novak Druce DeLuca + Quigg LLP; Robert J. Decker

(57) ABSTRACT

An embodiment provides a protection structure comprising: open cell core structure; a top face sheet coupled to said core structure; a bottom face sheet coupled to said core structure distal from said top face sheet; a projectile arresting layer coupled to said top face sheet distal from said core structure; and a fragment catching layer couple to said bottom face sheet distal from said core.

36 Claims, 2 Drawing Sheets

U.S. PATENT DOCUMENTS 4,067,956 A 1/1978 Franklin
4,130,233 A 12/1978 Chisholm
4,194,255 A 3/1980 Poppe
4,223,053 A 9/1980 Brogan
4,291,732 A 9/1981 Artzer
4,450,338 A 5/1984 Conn
4,453,367 A 6/1984 Geyer
4,469,077 A 9/1984 Wooldridge
4,522,860 A 6/1985 Scott
4,529,640 A * 7/1985 Brown et al. ..... 428/116
4,530,197 A 7/1985 Rainville
4,531,511 A 7/1985 Hochberg
4,625,710 A 12/1986 Harada
4,632,716 A 12/1986 Smith
4,639,388 A 1/1987 Ainsworth
4,687,702 A 8/1987 Monsees
4,756,943 A 7/1988 Koletzko
4,758,299 A * 7/1988 Burke ..... 156/313
4,765,396 A 8/1988 Seidenberg
4,819,719 A 4/1989 Grote
4,859,541 A 8/1989 Maxeiner
4,883,116 A 11/1989 Seidenberg
4,916,027 A 4/1990 Delmundo
4,918,281 A 4/1990 Blair
4,923,544 A 5/1990 Weisse
4,955,135 A 9/1990 Pinkhasov
4,968,367 A 11/1990 Diderich
5,002,378 A 3/1991 Colarusso
5,011,638 A 4/1991 Pinkhasov
5,040,966 A 8/1991 Weisse
5,070,673 A 12/1991 Weisse
5,102,723 A 4/1992 Pepin
5,110,661 A * 5/1992 Groves ..... 428/178
5,137,058 A 8/1992 Anahara
5,176,641 A 1/1993 Idriss
5,179,043 A 1/1993 Weichold
5,181,549 A 1/1993 Shapovalov
5,190,539 A 3/1993 Fletcher
5,217,770 A 6/1993 Morris
5,219,020 A 6/1993 Akachi
5,224,519 A 7/1993 Farley
5,266,279 A 11/1993 Haerle
5,282,861 A 2/1994 Kaplan
5,308,669 A 5/1994 Prucher
5,309,457 A 5/1994 Minch
5,312,660 A 5/1994 Morris
5,349,893 A 9/1994 Dunn
5,360,500 A 11/1994 Evans
5,401,583 A 3/1995 Stacher
5,417,686 A 5/1995 Peterson
5,424,139 A 6/1995 Shuler
5,431,800 A 7/1995 Kirchhoff
5,455,096 A * 10/1995 Toni et al. ..... 428/116
5,465,760 A 11/1995 Mohamed
5,471,905 A 12/1995 Martin
5,472,769 A 12/1995 Goerz
5,503,887 A 4/1996 Diaz
5,511,974 A 4/1996 Gordon
5,527,588 A 6/1996 Camarda
5,527,590 A 6/1996 Priluck
5,534,314 A 7/1996 Wadley
5,547,737 A 8/1996 Evans
5,591,162 A 1/1997 Fletcher
5,598,632 A 2/1997 Camarda
5,605,628 A 2/1997 Davidson
5,624,622 A 4/1997 Boyce
5,642,776 A 7/1997 Meyer
5,654,518 A 8/1997 Dobbs
5,656,984 A 8/1997 Paradis
5,673,561 A 10/1997 Moss
5,677,029 A 10/1997 Prevorsek
5,679,467 A 10/1997 Priluck
5,698,282 A 12/1997 DeMeyer
5,741,574 A 4/1998 Boyce
5,771,488 A 6/1998 Honkala
5,772,821 A 6/1998 Yasui
5,773,121 A 6/1998 Meteer
5,808,866 A 9/1998 Porter
5,817,391 A 10/1998 Rock
5,888,609 A 3/1999 Karttunen
5,888,912 A 3/1999 Piemonte
5,890,268 A 4/1999 Mullen
5,924,459 A 7/1999 Evans
5,943,543 A 8/1999 Uchida
5,962,150 A 10/1999 Priluck
5,970,843 A * 10/1999 Strasser et al. ..... 89/36.02
5,972,146 A 10/1999 Fantino
5,972,468 A 10/1999 Welch
6,003,591 A 12/1999 Campbell
6,076,324 A 6/2000 Daily
6,077,370 A 6/2000 Solvtsev
6,080,495 A 6/2000 Wright
6,082,443 A 7/2000 Yamamoto
6,170,560 B1 1/2001 Daily
6,175,495 B1 1/2001 Batchelder
6,176,964 B1 1/2001 Parente
6,189,286 B1 2/2001 Seible
6,200,664 B1 3/2001 Figge
6,204,200 B1 3/2001 Shieh
6,207,256 B1 3/2001 Tashiro
6,228,744 B1 5/2001 Levine
6,284,346 B1 9/2001 Sheridan
6,579,811 B2 6/2003 Narwankar
6,644,535 B2 11/2003 Wallach
6,676,797 B2 1/2004 Tippett
6,684,943 B2 2/2004 Dobbs
6,739,104 B2 5/2004 Tokonabe
6,740,381 B2 * 5/2004 Day et al. ..... 428/56
7,211,348 B2 5/2007 Wadley
2001/0030023 A1 * 10/2001 Tippett ..... 156/333

OTHER PUBLICATIONS

Wadley, "Manufacture of Cellular Metals: An Overview of Concepts for Stochastic and Periodic Materials," MetFoam 2001, (Jun. 18, 2001).
Unknown, "DUOCEL Foam Metal for Semiconductor Applications," ERG Materials and Aerospace Corporation website.
Unknown, ERG Materials and Aerospace Corporation website.
Unknown, "Reticulated Vitreous Carbon," ERG Materials and Aerospace Corporation website.
Unknown, "Properties of DUOCEL Silicon Carbide Foams," ERG Materials and Aerospace Corporation website.
Boomsma, "Metal Foams for Compact High Performance Heat Exchangers," Laboratory of Thermodynamics in Emerging Technologies, website 2001.
Gibson, "Metallic Foams: Structure, Properties and Applications," ICTAM 2000, (Aug. 28, 2000).
Unknown, "Directed Vapor Deposition of Ultralightweight Metal Foams," UVA website.
Unknown, "Micro Heat Exchangers," Institut for Mikrotechnik Mainz GmbH, (Feb. 1, 1998).
Naanes, "Grant funds University heat-exchanger project," The Reveille, Louisiana State University, (Nov. 9, 1999).
Unknown, "Solid Sorption Machines with Heat Pipe Heat Exchangers for Heat Transfer Enhancement and Thermal Control," U.S. Civilian Research & Development Foundation website, Abstract #BE1-107.
Itoh, "Itoh's Micro Heat Pipe Home Page," Itoh's website.
Unknown, "A High Performance Heat Sink Using Micro Heat-Pipes Now Available at Low Price," Furukawa Electric website, (Jan. 25, 2000).
Unknown, "The Application of Micro-Heat-Pipe in a Portable Electronic System," Industrial Technology Research Institute, vol. 7 (Winter), (1996).
Unknown, "Thermal Management—Heat Pipes," Fujikura Europe Limited website, United Kingdom.
Unknown, "Thermal Management—Heat Sinks," Fujikura Europe Limited website, United Kingdom.
Queheillalt, et al., "Electron beam—directed vapor deposition of multifunctional structures," Mat. Res. Soc. Symp. Proc., vol. 672, (Nov. 12, 2001).

Seok Hwan Moon, et al., "Experimental study on the thermal performance of micro-heat pipe with cross-section of polygon," Microelectronics Reliability 44 (2004) 315-321, (Feb. 12, 2003).
Sypeck, "Multifunctional microtruss laminates: Textile synthesis and properties," Mat. Res. Soc. Symp. Proc. vol. 672 2001 Materials Research Society.
Evans, "Lightweight materials and structures," MRS Bulletin Oct. 2001.
L. J. Gibson, "Mechanical Behavior of Metallic Foams," Annu. Rev. Matter. Sci., p. 191-227, 2000.

* cited by examiner

BLAST AND BALLISTIC PROTECTION SYSTEMS AND METHOD OF MAKING THE SAME

RELATED APPLICATIONS

This application is a national stage filing of International Application No. PCT/US2003/027605, filed on Sep. 3, 2003, which claims benefit under 35 U.S.C Section 119(e) from U.S. Provisional Application Ser. No. 60/407,723, filed on Sep. 3, 2002, entitled "Blast and Ballistic Protection Systems and Method of Making the Same," the entire disclosures of which are hereby incorporated by reference herein in their entirety.

US GOVERNMENT RIGHTS

This invention was made with United States Government support under Grant No. N0014-01-1-1051, awarded by the Defense Advanced Research Projects Agency/Office of Naval Research. The United States Government has certain rights in the invention.

BACKGROUND OF THE INVENTION

The present invention relates to both blast and ballistic protection structures by integrating high strength fibers, cells, foams and composite and pure materials; as well as method of manufacturing the same.

BRIEF SUMMARY OF INVENTION

An embodiment provides a protection structure comprising: open cell core structure; a top face sheet coupled to said core structure; a bottom face sheet coupled to said core structure distal from said top face sheet; a projectile arresting layer coupled to said top face sheet distal from said core structure; and a fragment catching layer couple to said bottom face sheet distal from said core.

An embodiment provides protection structure comprising: open cell core structure; a top face sheet coupled to said core structure; a bottom face sheet coupled to said core structure distal from said top face sheet; a projectile arresting structure disposed inside said core structure; and a fragment catching layer couple to said bottom face sheet distal from said core.

An embodiment provides protection structure comprising: open cell core structure; a top face sheet coupled to said core structure; a bottom face sheet coupled to said core structure distal from said top face sheet; a projectile arresting layer coupled to said top face sheet distal from said core structure; and a fragment catching structure disposed inside said core.

An embodiment provides a protection structure comprising: open cell core structure; a top face sheet coupled to said core structure; a bottom face sheet coupled to said core structure distal from said top face sheet; a projectile arresting layer coupled to said top face sheet distal from said core structure; and a fragment catching structure disposed inside said core and a fragment catching layer couple to said bottom face sheet distal from said core.

An embodiment provides a protection structure comprising: open cell core structure; a top face sheet coupled to said core structure; a bottom face sheet coupled to said core structure distal from said top face sheet; a projectile arresting structure disposed inside said core structure; and a fragment catching structure disposed inside said core.

An embodiment provides a method of making a protection structure comprising: providing an open cell core structure; coupling a top face sheet to said core structure; coupling a bottom face sheet to said core structure distal from said top face sheet; coupling a projectile arresting layer to said top face sheet distal from said core structure; and coupling a fragment catching layer to said bottom face sheet distal from said core.

An embodiment provides a method of making a protection structure comprising: providing an open cell core structure; coupling a top face sheet to said core structure; coupling a bottom face sheet to said core structure distal from said top face sheet; disposing a projectile arresting structure inside said core structure; and coupling a fragment catching layer to said bottom face sheet distal from said core.

An embodiment provides a method of making a protection structure comprising: providing an open cell core structure; coupling a top face sheet to said core structure; coupling a bottom face sheet to said core structure distal from said top face sheet; coupling a projectile arresting layer to said top face sheet distal from said core structure; and disposing a fragment catching structure inside said core.

An embodiment provides a method of making a protection structure comprising: providing an open cell core structure; coupling a top face sheet to said core structure; coupling a bottom face sheet to said core structure distal from said top face sheet; coupling a projectile arresting layer to said top face sheet distal from said core structure; and disposing a fragment catching structure inside said core and a fragment catching layer couple to said bottom face sheet distal from said core.

An embodiment provides a The method of making protection structure comprising: providing an open cell core structure; coupling a top face sheet to said core structure; coupling a bottom face sheet to said core structure distal from said top face sheet; disposing a projectile arresting structure inside said core structure; and disposing a fragment catching structure inside said core.

BRIEF SUMMARY OF THE DRAWINGS

The foregoing and other objects, features and advantages of the present invention, as well as the invention itself, will be more fully understood from the following description of preferred embodiments, when read together with the accompanying drawings, in which.

DETAILED DESCRIPTION OF THE INVENTION

Figure 1:
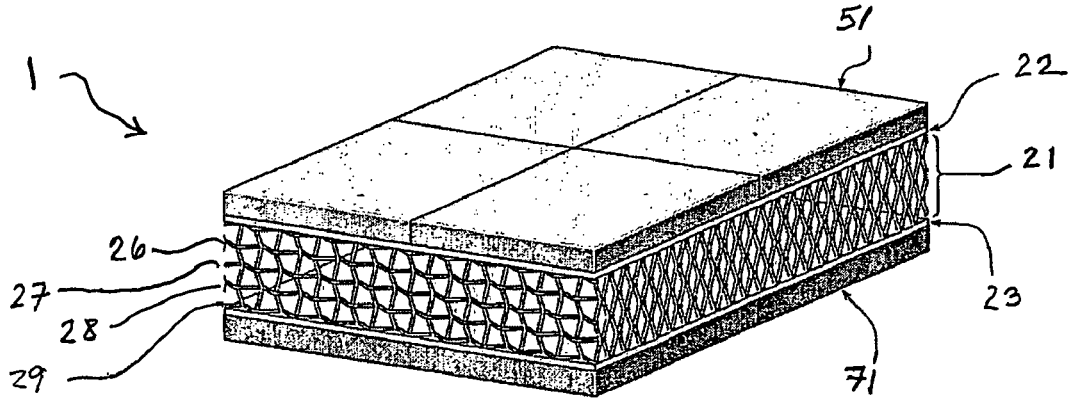
FIGS. 1-4 provide schematic illustrations of various respective embodiments for providing both blast and ballistic protection. It should be appreciated that the core, arresting layer, catching layer, intermediate components and any related components and aspects thereof have been simplified for the sake of illustration and thus it should be understood that these components can be a variety of forms and exist as a combination or sub-combination as discussed through out this document.

An embodiment of the present invention provides a periodic, open-cell core structure made from ductile metals or other materials to provide blast (and impact) protection. The embodiment is also effective when used as the cores of sandwich panel structures. An embodiment works by transforming the energy of the blast into plastic deformation of the core/facesheet system.

Referring generally to FIGS. 1-4, cores 21 include tetrahedral, pyramidal and Kagomé trusses, bilayer trusses, trilayer trusses, foams (e.g., open or stochastic), various woven or wire rectilinear arrays and honeycomb all bonded by, for example, transient liquid phase bonding, diffusion bonding, welding (including resistance methods) and adhesive bonding. By attaching a hard facesheet 51 (e.g., ceramic) to the exterior of the core 21 and utilizing the interior free volume to position additional ceramic 24 or ballistic fibers (e.g. Kevlar or Spectra fiber) 25 it is possible to erode, fracture, and rotate an incoming projectile. The core 21 (e.g., metal) aids the rotation process and increases the area of the fragment perpendicular to its propagation direction. A Kevlar or other ballistic fiber fabric, composite, or layer 71 then catches the fragment and stops its penetration through the area beyond the structure 1. Other materials other than Kevlar can be used such as, but not limited thereto, Spectra, S2 glass, and/or Zylon. Additional fragment catching fabrics/composites can be attached to the rearmost face of the core 21 to provide greater protection. Further, it is sometimes desirable to infiltrate laminates of this fabric with a hardening resin.

An embodiment utilizes a metallic cellular metal core 21 with strongly bonded facesheets 22, 23 to absorb (by plasticity) the blast energy (one or more face sheets may be omitted or added if desired). Additional facesheets can be applied between layers of the core so as to provide intermediate facesheets (not shown). The face sheets can be mesh, aperture, or perforated as desired. Projectiles are arrested by fracture/erosion during impact with a ceramic material 51 placed on the outer surface (or the interior of the core 21 as shown as reference 24 in FIGS. 3-4) or both. The core 21 induces projectile rotation so that a large area is presented for "capture" by a ballistic fabric 71. This fabric or other suitable structure can be placed in the core 21 (as shown as reference 25 in FIGS. 2 and 4) or attached to the back surface of the sandwich panel 23. The fabric 71 or ceramic 51 can be incorporated in a matrix (e.g. a polymer) to create a composite attached to the facesheets 22, 23 or impregnated within the core 21 and can be a wide variety of structure types and designs of fragment catching structure 25 or projectile arresting structure 24.

It should be appreciated that the protection structure 1, and any associated face sheets, cores, projectile arresting structures and layers, and projectile catching structure and layer as discussed throughout (as well as any sub-elements thereof) can be planar, substantially planar, and/or curved shape, with various contours as desired.

The core 21 can be any cellular metal, for example. The core may also be core systems for the highest performance applications. Examples are tetrahedral, pyramidal, Kagomé trusses, bilayer, trilayer, honeycomb, metal textiles or cores made from rectilinear arrays of solid or hollow tubes. Lower performance systems could use stochastic metal foams (e.g. Duocell or Cymat foams) or non-metals.

The ceramics could be ultra-hard, high density boron carbide, silicone carbide, or aluminum oxide. Various composites utilizing ceramic, metal, or polymer matrices can also utilized.

The protection system or structure 1 described above can be manufactured by a variety of methods. For example, the ceramic front sheet 51 is attached by metal to ceramic bonding methods. The ceramic can be added to the structure as small tiles with/without overlapping edges to accommodate thermal expansion mismatch. Ceramic or other suitable materials can be used. For instance, other structural forms and other acceptable materials, such as, but not limited thereto, include carbon matrix composites, fiber reinforced, particular reinforced, strips, applied layers, rods, spheres, chemically hardening slurries, cubes or other geometric shapes self contained as discussed in PCT International Application No. PCT/US03/23043, entitled "Method for Manufacture of Cellular Materials and Structures for Blast and Impact Mitigation and Resulting Structure," filed on Jul. 23, 2003 (of which is hereby incorporated by reference herein in its entirety). The ceramics can also be attached by many other approaches including adhesive bonding and mechanical attachment (bolts, rivets, etc.), but not limited thereto. Ceramics can be incorporated in the structure 1 or core 21 by slurry and dry powder infiltration methods. Adhesives or brazes can, if desired, be used to bond the ceramic to the metallic structure. All or just a part of the core can be filled with this material. Whereas one cellular metal core system is ideal for retaining ceramic particles and another for blast mitigation, multiple core systems can be used such that one of the aforementioned is stacked upon another. Multiple cores, face sheets, and sub-cores can be stacked upon one another.

Figure 2:
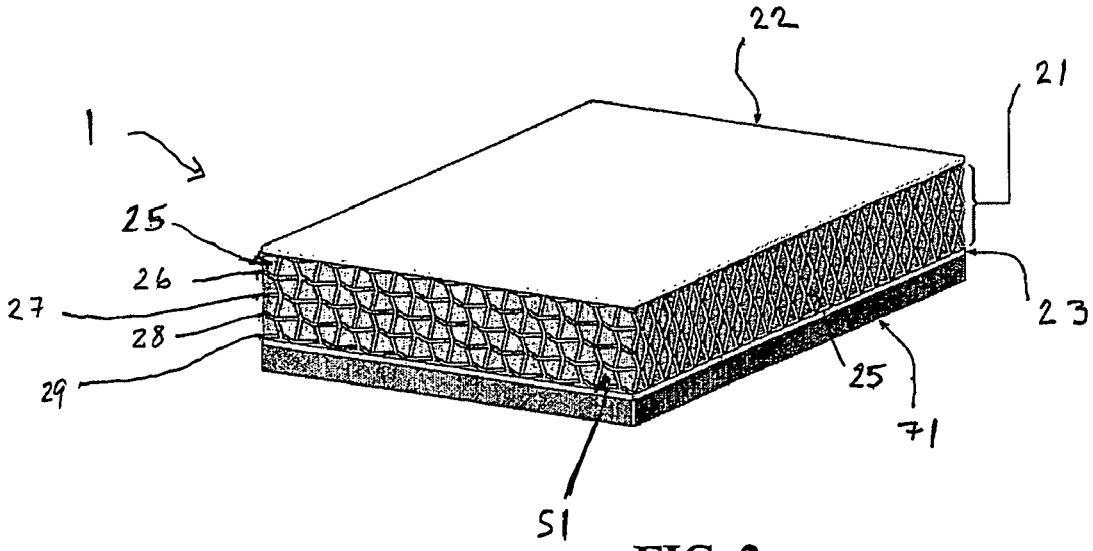
Figure 3:
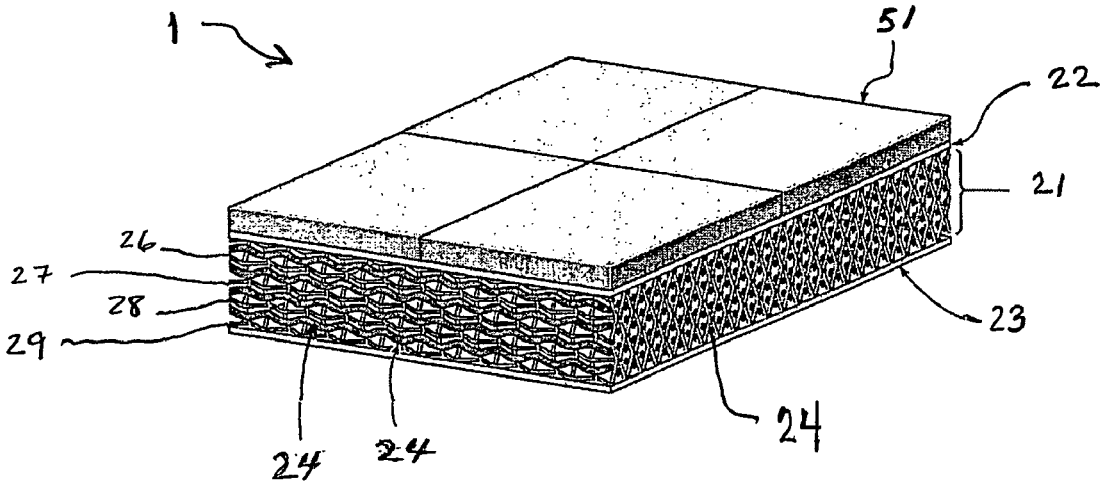
Figure 4:
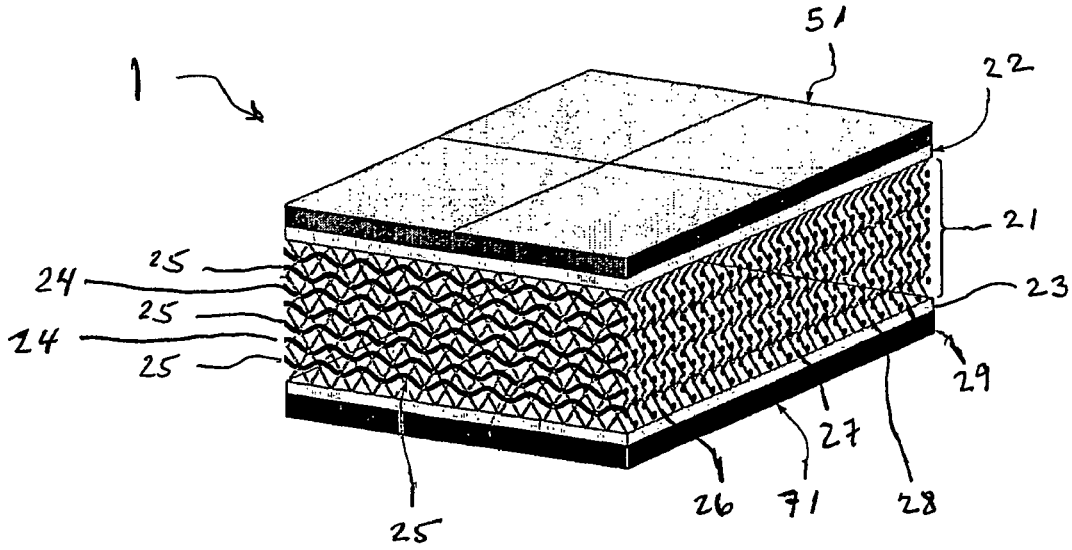

Ballistic fabrics can be used for the fragment catching structure 25 and can be inserted into completed periodic, open-cell core 21 (as shown in FIGS. 2 & 4). Because of the existence of straight, continuous channels fibers/fiber bows of pieces of woven tape can be inserted. Other structures other than tape can be used such as, but not limited thereto, ribbons and/or integrally woven layers. When low temperature metal bonding is used to make the core (e.g. resistance welding) the ballistic fabric 25 or suitable structure can be inserted in the core 21 before or as it is constructed.

The fabric or fabric composite backing layer (an exemplary form of reference 71) can be attached by adhesive or mechanical methods. Numerous mechanical attachment approaches can be envisioned.

Still generally to FIGS. 1-4, the core 21 may include one or a plurality of the truss layer 26, textile layer 27, perforated or aperture sheet 28, and/or open cell foam 29, or any combination or sub-combination as discussed throughout this document. With regards to the 1) core, 2) top, bottom, or intermediate face sheets, 3) truss arrays and truss units 4) textile layers, 5) perforated or aperture sheets, 6) open cell foams and stochastic foams, 7) bonding and adhesive techniques, 8) heating, 9) pressing, and 10) stacking of the aforementioned components and related handling, additional support can be referred to in the following applications that are owned by the Applicant and applied herein (and of which are hereby incorporated by reference herein in their entirety):

1. PCT International Application No. PCT/US01/17363, entitled "Multifunctional Periodic Cellular Solids And The Method Of Making Thereof," filed on May 29, 2001, and corresponding U.S. application Ser. No. 10/296,728, filed Nov. 25, 2002 (of which are hereby incorporated by reference herein in their entirety).
2. PCT International Application No. Application No. PCT/US02/17942, entitled "Multifunctional Periodic Cellular Solids and the Method of Making thereof," filed on Jun. 6, 2002 (of which is hereby incorporated by reference herein in its entirety);
3. PCT International Application No. PCT/US01/22266, entitled "Heat Exchange Foam," filed on Jul. 16, 2001, and corresponding U.S. application Ser. No. 10/333,004, filed Jan. 14, 2003 (of which are hereby incorporated by reference herein in their entirety)
4. PCT International Application No. PCT/US01/25158, entitled "Multifunctional Battery and Method of Making the Same," filed on Aug. 10, 2001, and corresponding U.S. application Ser. No. 10/110,368 filed Jul. 22, 2002 (of which are hereby incorporated by reference herein in their entirety)
5. PCT International Application No. PCT/US03/16844, entitled "Method for Manufacture of Periodic Cellular Structure and Resulting Periodic Cellular Structure,"

filed on May 29, 2003 (of which is hereby incorporated by reference herein in its entirety).

6. PCT International Application No. PCT/US03/23043, entitled "Method For Manufacture of Cellular Materials and Structures for Blast and Impact Mitigation and Resulting Structure," filed on Jul. 23, 2003. (of which is hereby incorporated by reference herein in its entirety).

7. PCT International Application No. PCT/US2003/027606, entitled "Method for Manufacture of Truss Core Sandwich Structures and Related Structures thereof," filed on Sep. 3, 2003. (of which is hereby incorporated by reference herein in its entirety).

The following publications, patents, patent applications are hereby incorporated by reference herein in their entirety:

1. U.S. Pat. No. 4,404,889 to Miguel
2. U.S. Pat. No. 4,979,425 to Sprague
3. U.S. Pat. No. 5,022,307 to Gibbons, Jr. et al.
4. U.S. Pat. No. 5,471,905 to Martin
5. U.S. Pat. No. 5,533,781 to Williams
6. U.S. Pat. No. 5,654,518 to Dobbs
7. U.S. Pat. No. 5,663,520 to Ladika et al.
8. U.S. Pat. No. 6,073,884 to Lavergne
9. U.S. Pat. No. 6,216,579 to Boos et al.
10. U.S. Pat. No. 6,253,655 to Lyons et al.
11. U.S. Pat. No. 6,286,785 to Kitchen
12. U.S. Pat. No. 6,526,862 to Lyons Of course it should be understood that a wide range of changes and modifications could be made to the preferred and alternate embodiments described above. It is therefore intended that the foregoing detailed description be understood that it is the following claims, including all equivalents, which are intended to define the scope of this invention.

We claim:

1. A protection structure comprising:
open cell core structure;
a top face sheet coupled to said core structure;
a bottom face sheet coupled to said core structure distal from said top face sheet;
a projectile arresting structure disposed inside said core structure; and
a fragment catching layer coupled to said bottom face sheet distal from said core.

2. A protection structure comprising:
open cell core structure;
a top face sheet coupled to said core structure;
a bottom face sheet coupled to said core structure distal from said top face sheet;
a projectile arresting layer coupled to said top face sheet distal from said core structure; and
a fragment catching structure disposed inside said core.

3. The protection structure of claim 2, further comprising:
a projectile arresting structure disposed in said core structure.

4. A protection structure comprising:
open cell core structure;
a top face sheet coupled to said core structure;
a bottom face sheet coupled to said core structure distal from said top face sheet;
a projectile arresting layer coupled to said top face sheet distal from said core structure; and
a fragment catching structure disposed inside said core and a fragment catching layer coupled to said bottom face sheet distal from said core.

5. The protection structure of claim 4 further comprising:
a projectile arresting structure disposed inside said core structure.

6. A protection structure comprising:
open cell core structure;
a top face sheet coupled to said core structure;
a bottom face sheet coupled to said core structure distal from said top face sheet;
a projectile arresting structure disposed inside said core structure; and
a fragment catching structure disposed inside said core.

7. The structure of any one of claims 1-6, wherein said core comprises:
at least one truss layer comprised of at least one truss unit.

8. The structure of claim 7, wherein said at least one truss unit has a geometrical shape of at least one of: tetrahedral, pyramidal, Kagome, bilayer, trilayer, cone, frustum, or combinations thereof.

9. The structure of claim 7, wherein said at least one truss unit has leg members.

10. The structure of claim 9, wherein at least one of said leg members is hollow or solid or combination thereof.

11. The structure of any one of claims 1-6, wherein said core comprises:
at least one textile layer, said textile layer comprised of at least one array of intersecting structural support members forming apertures of predetermined geometric configurations.

12. The structure of claim 11, wherein said structural support members are at least one of tubular filaments or wire filaments, or combination thereof.

13. The structure of claim 11, wherein said structural support members are made from at least one of woven material, woven mesh, square woven mesh, rectangular woven mesh, multisided woven mesh, knitted mesh, braided mesh, triaxial mesh, biaxial mesh, or quasi-triaxial mesh, or combination thereof.

14. The structure of any one of claims 1-6, wherein said core comprises:
at least one open cell foam comprised of at least one of hollow ligaments or solid ligaments or combination thereof.

15. The structure of any one of claims 2 or 4 wherein said projectile arresting layer comprises at least one of tiles, ceramic tiles, applied layers, fiber reinforced, particular reinforced, rods, spheres, chemically hardening slurries, cubes and/or other geometric shapes self contained.

16. The structure of any one of claims 2 or 4 wherein said projectile arresting layer comprises ceramic or partial composites of ceramic or combination thereof.

17. The structure of any one of claims 1 or 4 wherein said fragment catching layer comprises at least one of fabric, Kevlar fabric, Spectra fabric, S2 glass fabric, and/or Zylon fabric, tape, Kevlar tape, Spectra tape, S2 glass tape, and/or Zylon tape.

18. The structure of any one of claims 1 or 4, wherein said fragment catching layer comprises at least one of fabric, Kevlar fabric, Spectra fabric, S2 glass fabric, and/or Zylon fabric, wherein any of said fabrics are infiltrated with a hardening resin.

19. The structure of any one of claims 1 or 4 wherein said fragment catching layer comprises Kevlar, partial composites of Kevlar, Spectra, partial composites of Spectra, S2 glass, partial composites of S2 glass, Zylon, and/or partial composites of Zylon or combination thereof.

20. The structure of any one of claims 1, 3, 5, or 6 wherein said projectile arresting structure is selected from the group consisting of tape, ceramic tape, coating, fiber reinforced, particular reinforced, ceramic coating, powder, ceramic powder, partial composite of ceramic powder, ceramic fabric, and partial composite of ceramic fabric.

21. The structure of any one of claims 1, 3, 5, or 6 wherein said projectile arresting structure is at least one material selected from the group consisting of ceramic and partial composites of ceramic and combination thereof.

22. The structure of any one of claims 2, 3, 4, 5, or 6 wherein said fragment catching structure is selected from the group consisting of fabric, KEVLAR fabric, tape, KEVLAR tape, coating, KEVLAR coating, powder, KEVLAR powder, fabric, KEVLAR fabric, SPECTRA fabric, S2 glass fabric, ZYLON fabric, and combinations thereof.

23. The structure of any one of claims 2, 3, 4, 5, or 6 wherein said fragment catching structure is selected from the group consisting of fabric, KEVLAR fabric, tape, and KEVLAR tape, wherein any of said fabrics and/or tape are infiltrated with a hardening resin.

24. The structure of any one of claims 2, 3, 4, 5, or 6 wherein at least one of said fragment catching structure is selected from the group consisting of Kevlar or partial composites of Kevlar, Spectra, partial composites of Spectra, S2 glass, partial composites of S2 glass, Zylon, partial composites of Zylon, and combinations thereof.

25. The protection structure of claim 6, further comprising:
a projectile arresting layer coupled to said top face sheet distal from said core structure.

26. The protection structure of claim 25, further comprising:
a fragment catching layer coupled to said bottom face sheet distal from said core.

27. The protection structure of claim 6, further comprising:
a fragment catching layer coupled to said bottom face sheet distal from said core.

28. A method of making a protection structure comprising:
providing an open cell core structure;
coupling a top face sheet to said core structure;
coupling a bottom face sheet to said core structure distal from said top face sheet;
disposing a projectile arresting structure inside said core structure; and
coupling a fragment catching layer to said bottom face sheet distal from said core.

29. A method of making a protection structure comprising:
providing an open cell core structure;
coupling a top face sheet to said core structure;
coupling a bottom face sheet to said core structure distal from said top face sheet;
coupling a projectile arresting layer to said top face sheet distal from said core structure; and
disposing a fragment catching structure inside said core.

30. The method of claim 29, further comprising:
disposing a projectile arresting structure in said core structure.

31. A method of making a protection structure comprising:
providing an open cell core structure;
coupling a top face sheet to said core structure;
coupling a bottom face sheet to said core structure distal from said top face sheet;
coupling a projectile arresting layer to said top face sheet distal from said core structure; and
disposing a fragment catching structure inside said core and a fragment catching layer coupled to said bottom face sheet distal from said core.

32. The method of claim 31 further comprising:
disposing a projectile arresting structure inside said core structure.

33. A method of making a protection structure comprising:
providing an open cell core structure;
coupling a top face sheet to said core structure;
coupling a bottom face sheet to said core structure distal from said top face sheet;
disposing a projectile arresting structure inside said core structure; and
disposing a fragment catching structure inside said core structure.

34. The method of claim 33, further comprising:
coupling a projectile arresting layer to said top face sheet distal from said core structure.

35. The method of claim 34, further comprising:
coupling a fragment catching layer to said bottom face sheet distal from said core structure.

36. The method of claim 33, further comprising:
coupling a fragment catching layer to said bottom face sheet distal from said core structure.

* * * * *